US005390517A

United States Patent [19]

Yamada

[11] Patent Number: 5,390,517

[45] Date of Patent: Feb. 21, 1995

[54] DOOR LOCK HANDLE ASSEMBLY

[75] Inventor: Kenichi Yamada, Tokyo, Japan

[73] Assignee: Takigen Manufacturing Co. Ltd., Tokyo, Japan

[21] Appl. No.: 95,674

[22] Filed: Jul. 21, 1993

[30] Foreign Application Priority Data

Mar. 4, 1993 [JP] Japan ..... 5-069250

[51] Int. Cl.[6] ..... E05B 13/10

[52] U.S. Cl. ..... 70/210; 70/224

[58] Field of Search ..... 70/207, 208, 210, 211, 70/214, 215, 216, 224, 209, DIG. 31; 292/336.3, 347, 348

[56] References Cited

U.S. PATENT DOCUMENTS

| | | | |
|---|---|---|---|
| 4,484,462 | 11/1984 | Berkowitz | 70/224 |
| 4,505,139 | 3/1985 | Richards | 70/DIG. 31 |
| 4,535,613 | 8/1985 | Mastromatteo | 70/DIG. 31 |
| 4,604,879 | 8/1986 | Neary et al. | 70/224 |
| 4,655,059 | 4/1987 | Best et al. | 292/347 |
| 4,704,882 | 11/1987 | Takasaki | 70/215 |
| 4,706,478 | 12/1987 | Swan et al. | 70/210 |
| 5,067,758 | 11/1991 | Fann et al. | 292/347 |
| 5,156,359 | 10/1992 | Noble et al. | 70/208 |

*Primary Examiner*—Peter M. Cuomo
*Assistant Examiner*—Monica E. Millner
*Attorney, Agent, or Firm*—Martin Smolowitz

[57] ABSTRACT

A door lock handle assembly comprises a stationary member having a sleeve portion having a shaft bore with the surface thereof provided with a retainer projection, and a handle having a shaft portion having a rear end insertion groove. The shaft portion of the handle is inserted in the shaft bore of the stationary member with the retainer projection and the insertion groove engaged with each other. After completion of the insertion, the retainer projection is accommodated in a front end circumferential escape groove formed as part of the insertion groove.

The shaft portion of the handle is not detached from the sleeve portion of the stationary member when a rotational angle regulation member or a locking member is removed. The Stationary member can be secured to a door, so that by rotation of the handle a lock member can be engaged in a locking groove provided in an adjacent stationary structure.

3 Claims, 7 Drawing Sheets

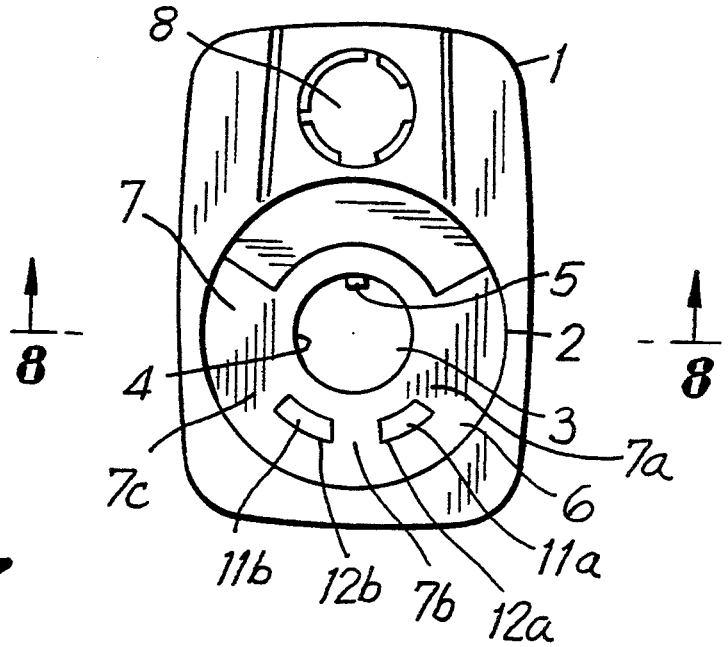
FIG. 7
FIG. 8
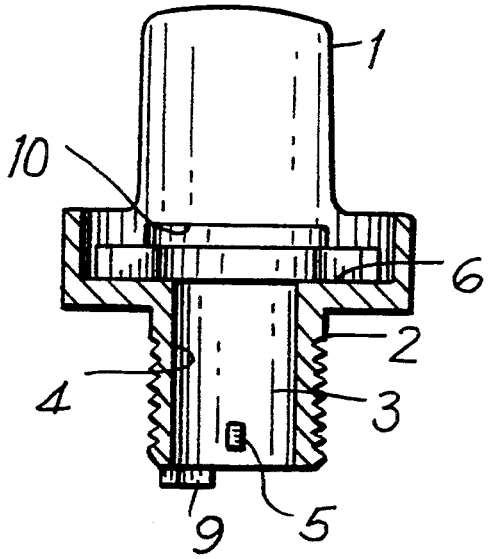

DOOR LOCK HANDLE ASSEMBLY

BACKGROUND OF THE INVENTION

1. Field of the Invention

This invention relates to door lock handle assemblies applied to containers mounted on container trucks, walk-in type refrigerators and so forth.

2. Prior Art

A prior art door lock handle assembly comprises a stationary member secured to a door and having a sleeve portion having a shaft bore, a handle having a shaft portion fitted in the shaft bore for rotation but not for axial displacement and having a rear end angular shaft portion, a locking member mounted on the angular shaft portion for rotation in an interlocked relation to the rotation of the handle and locking the door in engagement in an engagement groove formed on the side of the stationary member, the stationary member having an inner engagement groove, a lock lever pivoted by a transversal pin to a shaft bore formed in the handle, the lock lever having a fore end for engagement in the engagement groove to hold the handle in a predetermined position, the lock lever being biased by a spring for rotation in a direction of maintaining the engagement between its fore end and the engagement groove, a rotational angle regulator member fitted on the rear end angular shaft portion of the handle and urged against the wall surface of a rotational angle regulation projection projecting from the back side of the sleeve portion of the stationary member to regulate the rotational direction, a lock unit buried and secured in a lock unit accommodation groove formed in the stationary member and having a rotor and a locking member mounted on the rotor and capable of advancing and retreating in an interlocked relation to the rotation of the rotor of the lock unit, the handle being locked against rotation by the engagement of the locking member in a locking groove formed in the stem of the handle.

In such a prior art door lock handle assembly, however, the transversal pin for pivoting the lock lever to the handle is inserted in the shaft bore of the handle such that it is exposed to the outside. Therefore, the transversal pin is liable to be withdrawn from the outside of the handle to unlock the same in a state thereof locked to the stationary member.

In addition, in the prior art door lock handle assembly, if it is necessary to change the rotational direction of the handle or the orientation of the locking member in dependence on the positional relation between the door and stationary member, the rotational angle regulation member and locking member which are mounted in a rear end portion of the handle shaft portion are removed and then mounted again in the changed orientation.

However, such a method of changing the rotational direction and orientation has a drawback that the handle shaft portion is liable to be detached from the sleeve portion of the stationary members when the rotational angle regulation member and locking member are removed.

SUMMARY OF THE INVENTION

An object of the invention is to provide a door lock handle assembly, which prevents withdrawal of the transversal pin and permits reliable lock of the handle.

Another object of the invention is to provide a door lock handle assembly, which can prevent detachment of the handle shaft portion from the sleeve portion of the stationary member when the rotational angle regulation member and locking member are removed.

To attain the above objects of the invention, there is provided a door lock handle assembly, which comprises a lock lever having a stem with a transversal pin mounted therein, a handle having inner bearing grooves receiving opposite ends of the transversal pin, the handle having a shaft portion having an intermediate portion formed with an arcuate bearing groove, an arcuate member immovably fitted in the arcuate bearing groove and having pin retainers, the lock lever being pivoted to the handle with the opposite ends of the transversal pin received in the inner bearing grooves such that displacement of the transversal pin in the direction perpendicular thereto is prevented by the pin retainers, a stationary member having a sleeve portion having a shaft bore and also having a retainer projection projecting from the surface of the shaft bore, the shaft portion of the handle having a rear end formed with an insertion groove having a front end circumferential escape groove, the shaft portion of the handle being inserted in the shaft bore of the sleeve portion of the stationary member such that it can be rotated but its axial displacement is prevented with the retainer projection engaged in the insertion groove, the inner peripheral surface of the sleeve portion of the stationary member being formed with an engagement groove, the lock lever having a fore end thereof engaged in the engagement groove to hold the handle in a predetermined position, the lock lever being biased by a spring for rotation in a direction of maintaining the engagement between the fore end of the lock lever and the engagement groove, a lock unit buried and secured in a lock unit accommodation groove and having a rotor, and a locking member mounted on the rotor and capable of being advanced and retreated in an interlocked relation to the rotation of the rotor, the locking member having a fore end engaged in a locking groove formed in the stem of the handle to lock the handle against rotation.

In this structure, the opposite ends of the transversal pin are accommodated in the handle and are not exposed to the outside. This means that it is impossible to take out the transversal pin from the outside. Thus, it is possible to prevent unfair unlocking. In addition, since the transversal pin is completely accommodated in the handle, the door lock handle assembly may have a smart appearance.

Further, the handle is inserted in the shaft bore such that it can be rotated but can not be axially displaced. Thus, it is possible to prevent detachment of the handle from the shaft bore when replacing the rotational angle regulation member or locking member.

BRIEF DESCRIPTION OF THE DRAWINGS

FIG. 7 a is a plan view showing a stationary member used for the same door lock handle assembly;

FIG. 8 is a sectional view taken along line 8—8 in FIG. 7;

DETAILED DESCRIPTION OF THE PREFERRED EMBODIMENTS

Figure 1:
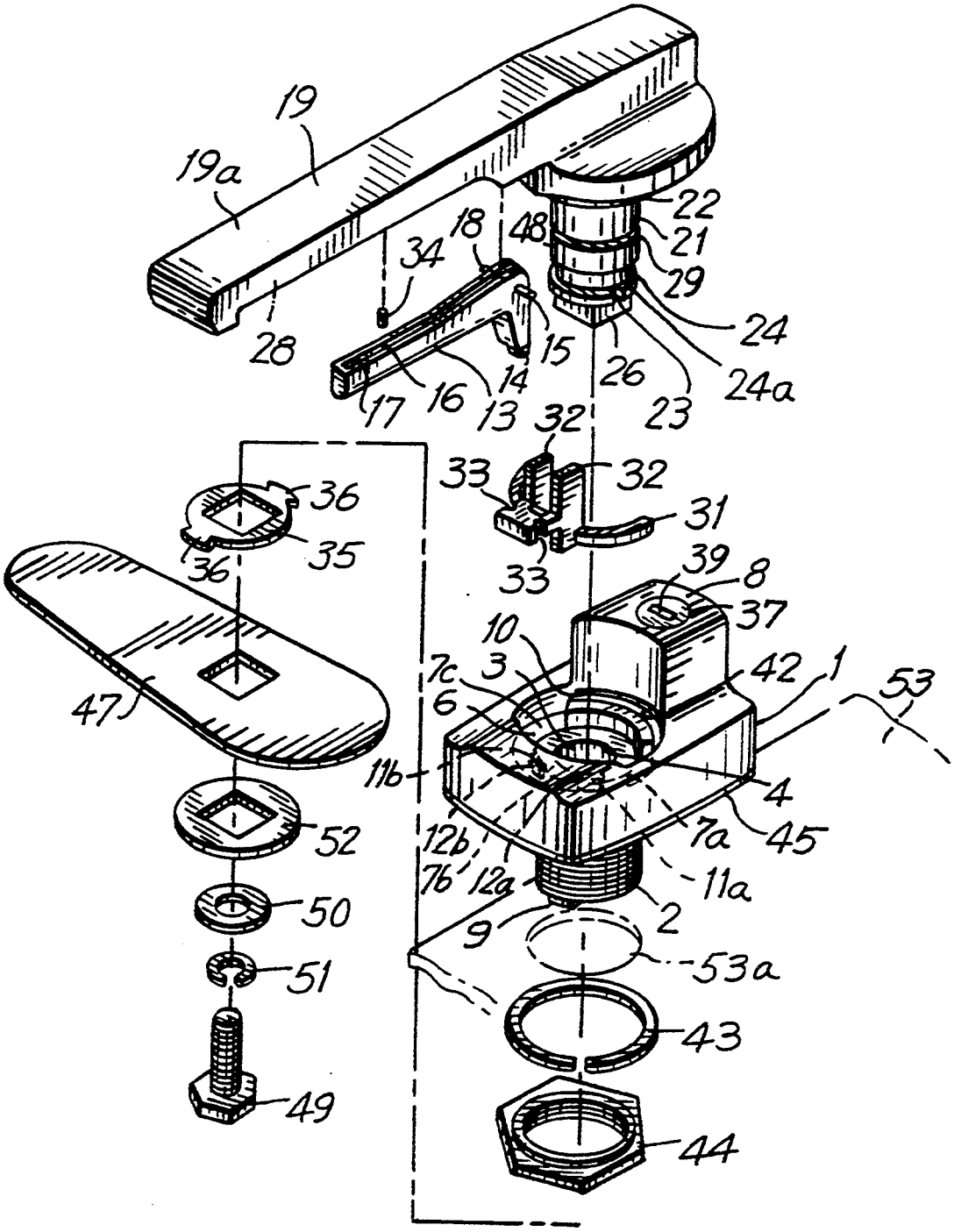
FIG. 1 is an exploded perspective view showing an embodiment of the door lock handle assembly according to the invention.
Figure 2:
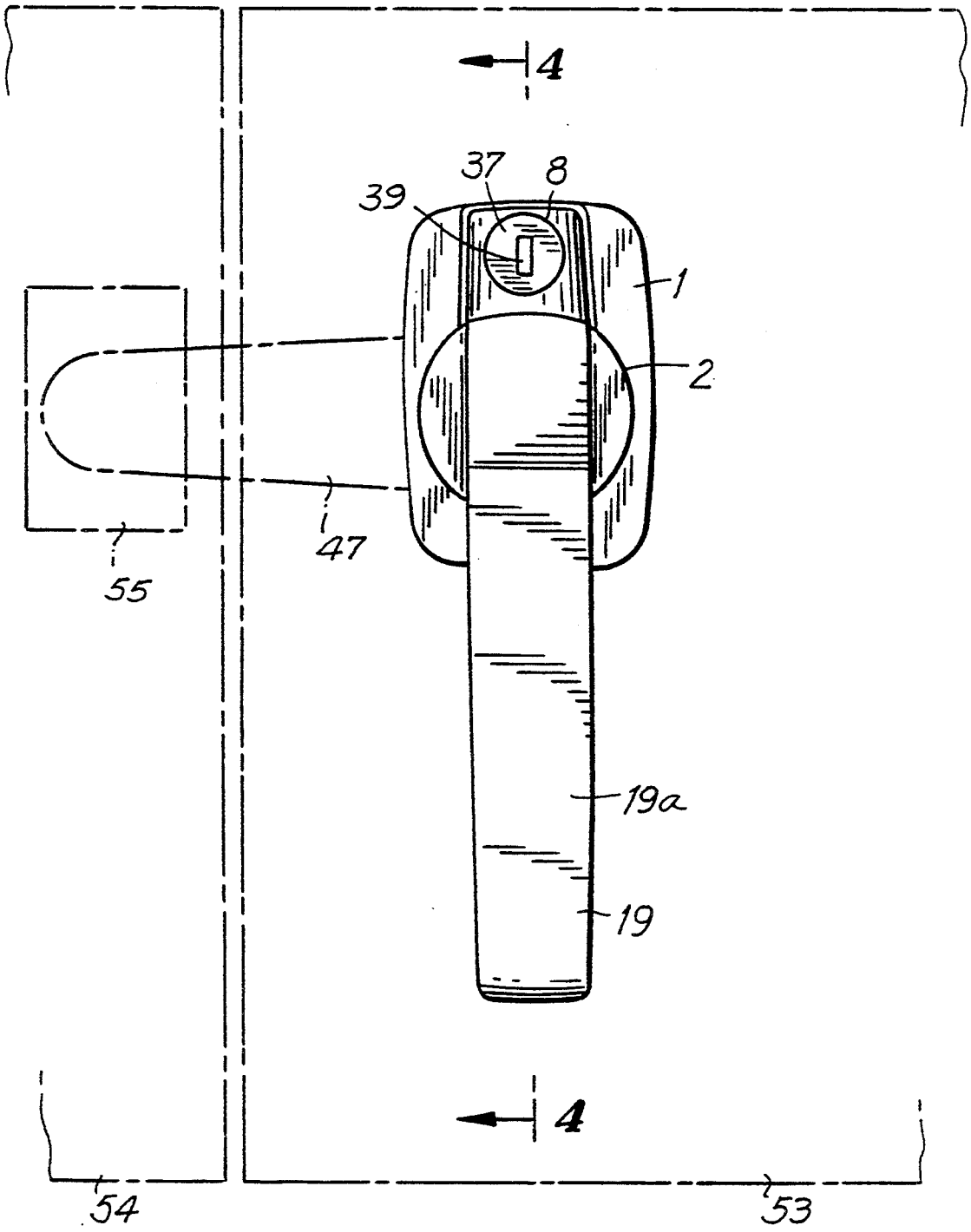
FIG. 2 is a front view showing the same door lock handle assembly.

A door lock handle assembly embodying the invention will be now described with reference to the drawings. Referring to the Figures, a lock lever 13 has a stem with a transversal pin 18 mounted therein. Opposite ends of the transversal pin 18 are fitted in inner bearing grooves 20 formed in a handle 19. The handle 19 has a shaft portion with an intermediate portion thereof formed with an arcuate bearing groove 22, in which an arcuate member 31 having pin retainers 32 is immovably fitted. The lock lever 13 is pivoted to the handle 19 with the opposite ends of the transversal pin 18 received in the inner bearing grooves 20, such that displacement of the pin 18 in directions perpendicular thereto is prevented by the pin retainers 32.

A stationary member 1 has a sleeve portion 2 having a shaft bore 3. A retainer projection 5 projects from the surface 4 of the shaft bore 3. The shaft portion 21 of the handle 19 has its rear end formed with an insertion groove 23. The shaft portion 21 of the handle 19 is inserted in the shaft bore 3 of the sleeve portion 2 of the stationary member 1. The insertion groove 23 has a front end circumferential escape groove 24 for escape therein of the retainer projection 5, The shaft portion 21 of the handle 19 is thus fitted in the shaft bore 3 of the sleeve portion 2 of the stationary member 1, such that it can be rotated but can not be axially displaced, The inner peripheral surface 6 of the sleeve portion 2 of the stationary member 1 is formed with an engagement groove 7, in which a fore end 14 of the lock lever 13 is engaged. The handle 19 is thus secured in a predetermined position. The lock lever 13 is biased by a spring 34 for rotation in the direction of maintaining the engagement between the fore portion 14 of the lock lever 13 and the engagement groove 7.

The stationary member 1 has a stem having a lock unit accommodation groove 8, in which a lock unit 37 is buried and secured. The lock unit 37 has a rotor 38, and a locking member 42 having a large width is mounted on the rotor 38 such that it can be advanced and retreated in an interlocked relation to the rotor 38. The handle 19 is locked against rotation by the engagement of the locking member 42 in a locking groove 25 formed in the stem of the handle 19.

With this door lock handle assembly, a door 53, which is secured to the stationary member 1, is locked by the engagement of an end of a lock member 47 in a locking groove 55 formed in the stationary structure 54.

To unlock the door 53, the handle 19, which is in its vertical position in the state of lock, is turned to a horizontal position. With the rotation of the handle 19 the lock member 47 is also rotated to be detached from the locking groove 55, thus unlocking the door 53. The door 53 is opened and closed with the handle 19 held in its horizontal position.

As noted above, the opposite ends of the transversal pin 18 mounted in the stem of the lock lever 13 are received in the inner bearing grooves 20 of the handle 19, the arcuate member 31 with the pin retainers 32 is immovably fitted in the arcuate bearing groove 22 formed in the intermediate portion of the shaft portion 21 of the handle 19, and the lock lever 13 is pivoted to the handle 19 with the opposite ends of the transversal pin 18 received in the inner bearing grooves 20 such that displacement of the pin 18 in direction perpendicular thereto is prevented by the pin retainers 32.

When the engagement groove 7 formed in the inner peripheral surface 6 of the sleeve portion 2 of the stationary member 1 and the fore end 14 of the lock lever 13 are engaged with each other, the handle 19 is secured in a vertically or horizontally elongate state. The handle 19 is turned after releasing the engagement between the fore end 14 of the lock lever 13 and the engagement groove 7 by pushing the lock lever 13 upward. Since the lock lever 13 is biased by the spring 34 for rotation in the direction of maintaining the engagement between the fore end 14 of the lock lever 13 and the engagement groove 7, the fore end 14 of the lock lever 13 is automatically rotated by 90 degrees when the vertically or horizontally elongate state is brought about.

The sleeve portion 2 of the stationary member 1 is inserted through a through hole **53*a* formed in the door 53, as shown in FIG. 1. Then, from the back side of the door 53, a washer 43 for preventing the rotation of the stationary member 1 is fitted on the sleeve portion 2, and the stationary member 1 is secured by fitting a nut 44. A packing 45 is provided between the bottom of the stationary member 1 and the front surface of the door 53**.

Figure 9:
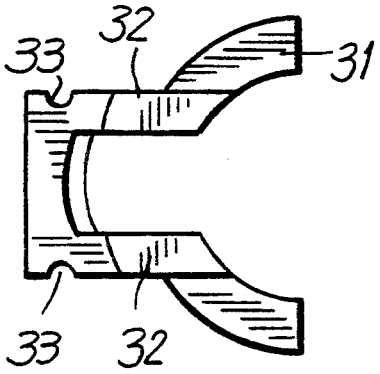
FIG. 9 is a plan view showing a retainer ring used for the same door lock handle assembly.
Figure 10:
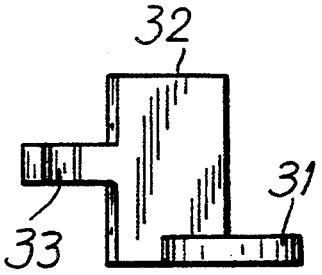
FIG. 10 is a front view showing the same retainer ring.

As noted before, the handle 19 has opposed inner bearing grooves. 20, which receive the opposite ends of the transversal pin 18 mounted in the stem of the lock lever 13. The arcuate member 31 with the pin retainers 32, as shown clearly in FIGS. 9 and 10, is immovably fitted in the arcuate bearing groove 22 formed in the intermediate portion of the shaft portion 21 of the handle 19. The lock lever 13 is pivoted to the handle 19 with the displacement of the transversal pin 18 in a direction perpendicular thereto prevented by the pin retainers 32, which also close the inner bearing groove 20. The arcuate member 31 has recesses 33 formed on the opposite sides and fitted on inner protuberances 27 provided on opposite side inner wall surfaces of the handle 19.

The shaft portion 21 of the handle 19 is inserted into the shaft bore 3 of the stationary member 1 by engaging the insertion groove 23 formed in the rear end of the shaft portion 21 of the handle 19 on the retainer projection 5 provided on the surface 4 of the shaft bore 3. When the insertion is completed, the retainer projection 5 is accommodated in the escape groove 24 of the shaft portion 21, and the handle 19 is made rotatable. In addition, the shaft portion 21 of the handle 19 is made incapable of axial displacement except when the retainer protection and the insertion groove 23 are engaged with each other, thus preventing the detachment of the handle 19 from the shaft bore 3.

Figure 3:
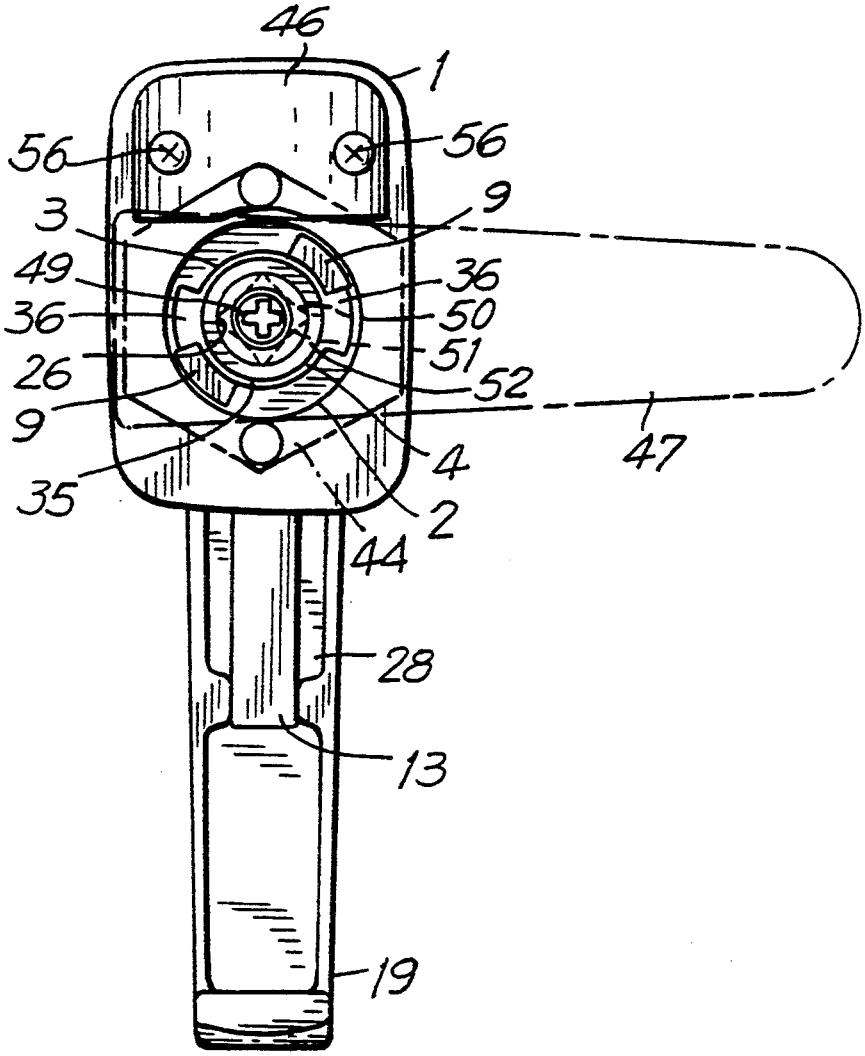
FIG. 3 is a back view showing the same door lock handle assembly.
Figure 4:
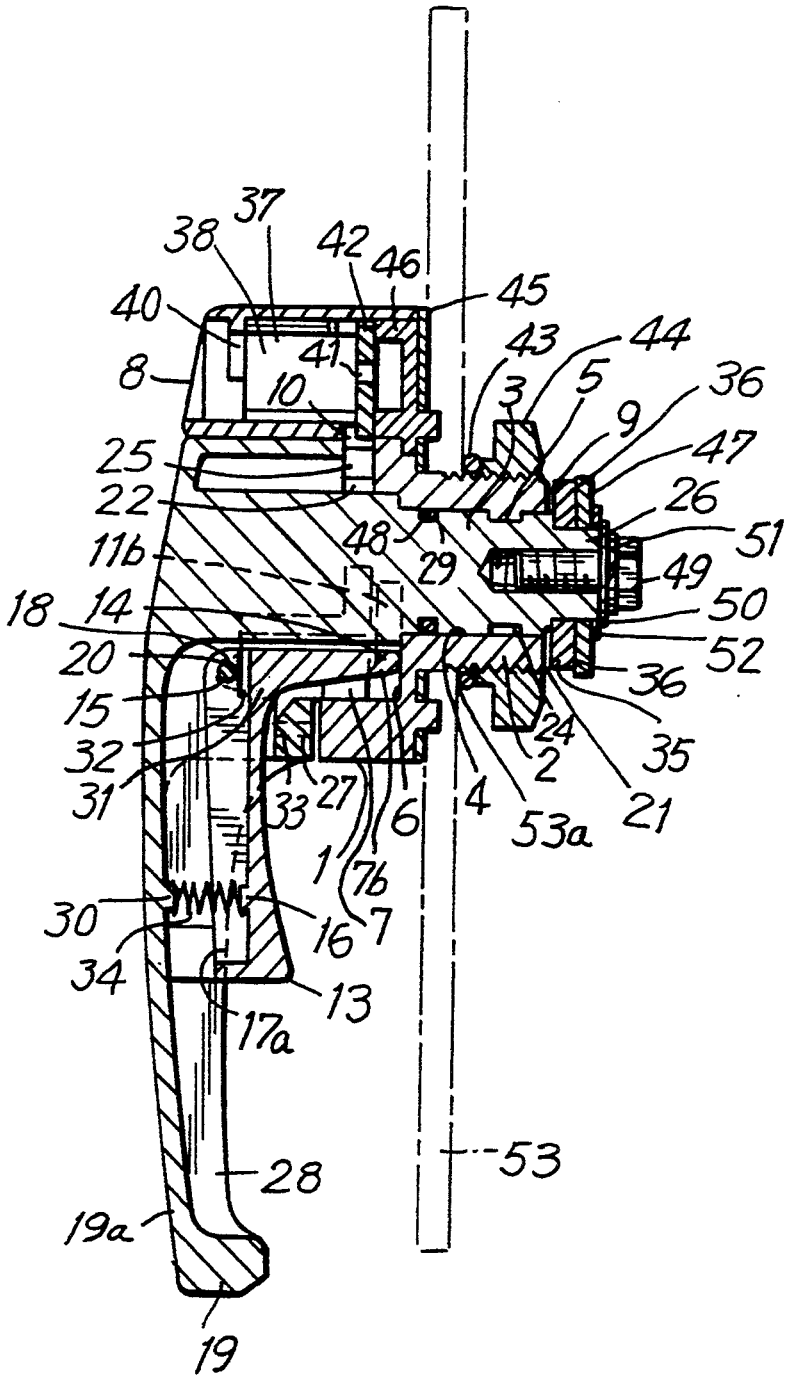
FIG. 4 is a sectional view taken along line 4—4 in FIG. 2.
Figure 5:
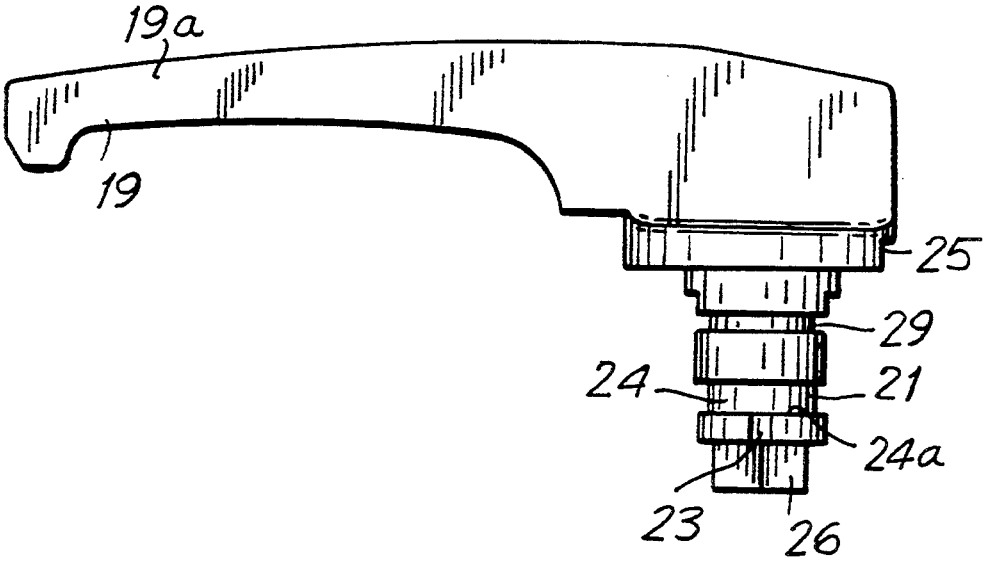
FIG. 5 is a front view showing a handle used for the same door lock handle assembly.
Figure 6:
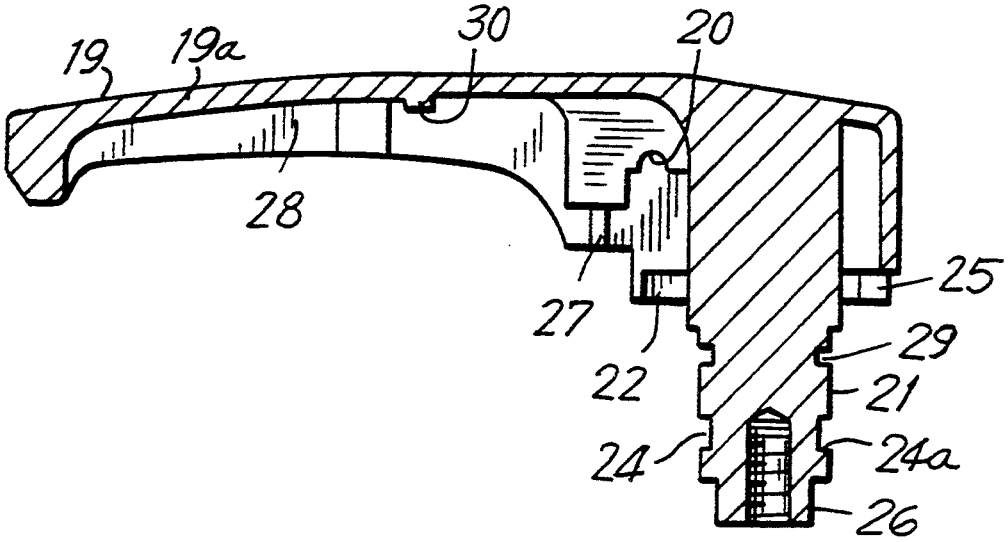
FIG. 6 is a sectional view showing the same handle.

The stationary member 1 has rotational angle regulation projection 9.provided on the back side of the sleeve portion 2. A rotational angle regulation member 35 which is mounted on an angular shaft portion 26 at the rear end of the shaft portion 21 of the handle 19, has side projection 36 adapted to urge the rotational angle regulation projection 9, thus regulating the rotational angle and limiting the rotational direction. In this embodiment, the rotational angle regulation member 35 is mounted such that it is oriented as shown in FIG. 3. Depending on the positional relation between the door 53 and the stationary structure 54, the handle may have to be turned in the opposite direction to that in this embodiment. In such a case, the mounting orientation of the rotational angle regulation member 35 is turned by 90 degrees from the state shown in FIG. 3. By so doing, the handle 19 can be rotated from its vertically elongate state in the clockwise direction by 90 degrees.

The engagement groove 7 formed in the inner peripheral surface 4 of the sleeve portion 2 of the stationary member 1 comprises three separate grooves *7a* to *7c* to engage on the fore end 14 of the lock lever 13 so as to hold the handle 19 in a predetermined position. To bias the lock lever 13 for rotation in the directions of maintaining the fore end 14 of the lock lever 13 and the engagement groove 7, a coil spring is mounted as the spring 34 between protuberances 30 and 16, respectively provided on the surfaces of an inner escape recess 28 provided in a grip portion 19*a* of the handle 19, into which the lock lever 13 is pushed, and a fore portion 17*a* of an upper groove 17 formed in the lock lever 13. The handle 19 is turned after releasing the engagement between the fore portion 14 of the lock lever and the engagement groove 7 by pushing up the lock lever 13 by applying a torque exceeding the rotational biasing force of the handle spring 34. During the rotation, the fore end 14 of the lock lever 13 is in engagement with the side surface 12*a* of a protuberance 11*a* intervening between engagement grooves *7a* and *7b*, and if the torque applied to the lock lever 13 is zero or less than the rotational biasing force of the spring 34, rotation up to the engagement groove 7 automatically brings about the engagement between the fore end 14 of the lock lever 13 and the engagement groove 7 to lock the handle 19 at a predetermined position. In this embodiment, the fore end 14 of the lock lever 13 is engaged in the engagement groove *7b* in case where the handle 19 is secured in the vertically elongate state thereof, while it is engaged in the engagement groove *7a* in case where the handle is secured in the horizontally elongate state. The coil spring 34 for rotationally biasing the lock lever 13, may be replaced with a torsion spring such that the coil portion there is coupled to the transversal pin 18 and that the opposite end straight portions are disposed in the escape recess 28 and the groove 17, respectively.

Figure 11:
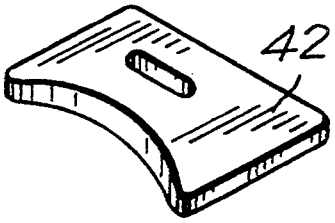
FIG. 11 is a perspective view showing a set member used for the same door lock handle assembly.

The lock unit 37 is buried and secured in the lock unit accommodation groove 8 of the stationary member 1 by driving a retainer pin 40 into the lock unit 37, and the locking member 42 is mounted on a shaft 41 of the rotor 38. The locking member 42 can undergo back-and-forth sliding movement between a bottom portion 37*a* of the lock unit and a retainer 46 accommodated in the lock unit accommodation groove 8 and secured in position by a screw 56, and its free end projects through a slit 10 communicating the lock unit accommodation groove 8 and the inner periphery 6 of 1 the sleeve portion 2. By securing the handle 19 in the vertically elongate state thereof, engaging the lock member in the locking groove 55 of the stationary structure 54 and engaging the fore end of the locking member 42 in the locking groove 25 in the stem of the handle 19 by turning the rotor 38 with a key inserted in a key hole 39 of the lock unit 37, the handle 19 is locked against rotation, thus effecting the lock of the door 53. The locking member 42, as shown in FIG. 11, has a large width and is sufficiently mechanically strong.

As shown in FIG. 1, a water-proof O-ring 48 is fitted in a peripheral groove 29 formed in an intermediate portion of the shaft portion 21 of the handle 19. The rotational angle regulation member 35 and lock member 47 are fitted on the angular shaft portion 26 of the shaft portion 21 of the handle 19 and secured against rotation to the shaft portion 26 by a bolt 49. When the handle 19 is in its vertically elongate state, the lock member 47 projects from the door 53 and is engaged in the groove 55 in the stationary structure 54. When the handle 19 is in its horizontally elongate state, the lock member 47 and groove 55 are out of engagement. The door 53 is opened and closed with the handle 19 held in the horizontally elongate state.

As has been described in the foregoing, in the door lock handle assembly according to the invention, the opposite ends of the transversal pin 18 mounted in the stem of the lock lever 13 are fitted in the inner bearing grooves 20 formed in the handle 19, and the arcuate member 31 having the pin retainers 32 is immovably fitted in the arcuate bearing groove 22 formed in an intermediate portion of the shaft portion 21 Of the handle 19, the lock lever 13 being pivoted to the handle 19 with the opposite ends of the transversal pin 18 received in the inner bearing grooves 20 such that displacement of the transversal pin 18 in a direction perpendicular thereto is prevented by the pin retainers 32. In this structure, the opposite ends of the transversal pin 18 are accommodated in the handle 19 and are not exposed to the outside. That is, the transversal pin 18 can not be taken out from the outside. It is thus possible to prevent unfair unlocking. In addition, since the transversal pin 18 is accommodated in the handle 19, the door lock handle assembly may have a smart appearance.

Further, the shaft portion 21 of the handle 19 has its rear end formed with the insertion groove 23, and is inserted in the shaft bore 3 of the stationary member 1 with the retainer projection 5 thereof inserted in the insertion groove 23, and afterwards the retainer projection 5 is accommodated in the circumferential escape groove 24 formed in the front portion of the insertion groove 23. Thus, the handle 19 is inserted in the shaft bore 3 such that it can be rotated but can not be axially displaced. It is thus possible to prevent detachment of the handle 19 from the shaft bore 3 when replacing the rotational angle regulation member 35 or locking member 47.

Further, the lock unit 37 having the rotor 38 is buried and secured in the lock unit accommodation groove 8 formed in the stationary member 1, and the locking member 42 is mounted on the rotor 38 for advance and retreat in an interlocked relation to the rotor 38, the locking member 42 being capable of being engaged in the locking groove 25 formed in the stem of the handle 19 to lock the handle against rotation. The locking member 42 has a large width compared to that disclosed in the prior art and thus has improved mechanical strength.

What is claimed is:

1. A door lock handle assembly, comprising a lock lever 13 having a stem with a transversal pin 18 mounted therein, a handle 19 having inner bearing grooves 20 for receiving opposite ends of said transversal pin 18, said handle 19 having a shaft portion 21 having an intermediate portion formed with an arcuate bearing groove 22;

an arcuate member 31 immovably fitted in said arcuate bearing groove 22 and having pin retainers 32, said lock lever 13 being pivoted to said handle 19 with the opposite ends of said transversal pin 18 received in said inner bearing grooves 20 such that displacement of said transversal pin 18 in a direction perpendicular thereto is prevented by said pin retainers 32;

a stationary member 1 having a sleeve portion 2 having a shaft bore 3 and also having a retainer projection 5 projecting from a surface 4 of said shaft bore 3, said shaft portion 21 of said handle 19 having a rear end formed with an insertion groove 23 having a front end circumferential escape groove 24, said shaft portion 21 of said handle 19 being inserted in said shaft bore 3 of said sleeve portion 2 of said stationary member 1, such that it can be rotated but its axial displacement is prevented with the retainer projection 5 engaged in said insertion groove 23, a inner peripheral surface 6 of said sleeve portion 2 of said stationary member 1 being formed with an engagement groove 7, said lock lever 13 having a fore end 14 thereof engaged in said engagement groove 7 to hold said handle 19 in a predetermined position, said lock lever 13 being biased by a spring 34 for rotation in a direction of maintaining the engagement between said fore end of said lock lever 13 and said engagement groove 7;

a lock unit 37 buried and secured in a lock unit accommodation groove 8 and having a rotor 38, and a locking member 42 mounted on said rotor 38 and capable of being advanced and retreated in an interlocked relation to the rotation of said rotor 38, said locking member 42 having a fore end engaged in a locking groove 25 formed in the stem of said handle 19 to lock said handle against rotation.

2. A door lock handle assembly according to claim 1, wherein said spring 34 is mounted between a protuberance 16 of said lock lever 13 and a protuberance 30 of said handle 19.

3. A door lock handle assembly according to claim 1, wherein said stationary member 1 is mounted onto a door 53 by said sleeve portion 2 being inserted through a hole **53*a* formed in the door and a washer 43 is fitted onto the sleeve portion and secured by a nut 44**.

* * * * *